United States Patent [19]

Taggi

[11] Patent Number: 4,670,370

[45] Date of Patent: Jun. 2, 1987

[54] PROCESS FOR PREPARATION OF COLOR LIQUID TONER FOR ELECTROSTATIC IMAGING USING CARBON STEEL PARTICULATE MEDIA

[75] Inventor: Arthur J. Taggi, Hockessin, Del.

[73] Assignee: E. I. Du Pont de Nemours and Company, Wilmington, Del.

[21] Appl. No.: 847,520

[22] Filed: Apr. 3, 1986

[51] Int. Cl.[4] ..... G03G 9/00; B02C 17/20

[52] U.S. Cl. ..... 430/137; 241/184; 106/288 Q

[58] Field of Search ..... 430/137; 241/184

[56] References Cited

U.S. PATENT DOCUMENTS

| | | | |
|---|---|---|---|
| 3,904,130 | 9/1975 | Delfosse et al. | 241/184 X |
| 4,013,462 | 3/1977 | Goffe et al. | 430/41 |
| 4,226,634 | 10/1980 | Dimroth et al. | 241/184 X |

FOREIGN PATENT DOCUMENTS

| | | |
|---|---|---|
| 57-51241 | 3/1982 | Japan . |
| 2169416 | 7/1986 | United Kingdom . |

OTHER PUBLICATIONS

Mining Engineering, vol. 12, No. 10, 10/1960, p. 1071.

*Primary Examiner*—J. David Welsh

[57] ABSTRACT

Process for preparation of toner particles for electrostatic imaging comprising

A. dispersing at an elevated temperature in a vessel a thermoplastic resin, a dispersant nonpolar liquid having a Kauri-butanol value of less than 30 and a colorant other than black, e.g., yellow, cyan, magenta, the temperature being maintained to plasticize and liquify the resin and below that at which the nonpolar liquid degrades and any component decomposes:

B. cooling the dispersion, either (1) with or without stirring to form a gel or solid mass, the shredding and grinding the mass by means of particulate media in the presence of additional liquid;

(2) with stirring to form a viscous mixture and grinding by means of particulate media in the presence of additional liquid; or (3) while grinding with particulate media thereby preventing formation of a gel or solid mass in the presence of additional liquid, and C. separating the dispersion of toner particles, average by area particle size less than 10 μm, from the particulate media which are carbon steel. The dispersion having a concentration of toner particles is useful for the preparation of copies and proofs of various colors, which have excellent color conformity.

19 Claims, No Drawings

PROCESS FOR PREPARATION OF COLOR LIQUID TONER FOR ELECTROSTATIC IMAGING USING CARBON STEEL PARTICULATE MEDIA

TECHNICAL FIELD

This invention relates to an improved process for the preparation of color toner particles. More particularly this invention relates to a process for the preparation of color toner particles in a liquid medium for electrostatic imaging in a vessel using particulate media of carbon steel.

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liguid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Several processes for preparing color liquid toners for electrostatic imaging are known. These include: (A) dispersing in a vessel at an elevated temperature a thermoplastic resin, a dispersant nonpolar liquid having a Kauri-butanol value of less than 30, and optionally a colorant while maintaininq the temperature in the vessel at a temperature sufficient to plasticize and liquify the resin: (B) cooling the dispersion by one of the following:

(1) without stirring to form a gel or solid mass, followed by shredding the gel or solid mass and grinding by means of particulate media in the presence of additional liquid;

(2) with stirring to form a viscous mixture and grinding by means of particulate media in the presence of additional liquid; or (3) while grinding by means of particulate media to prevent the formation of a gel or solid mass in the presence of additional liquid; and (C) separating the dispersion of toner particles from the particulate media. The standard media generally used for grinding are balls of stainless steel. Ceramic is another material used as particulate media. It has been found that when stainless steel particulate media are used as the grinding medium in preparing color liquid toners the toners become contaminated, i.e., undergo severe color change. When ceramic type particulate media are used for grinding, the ceramic abrades and contaminates the liquid toner with opaque, relatively large particle pieces of ceramic.

It has been found that the above disadvantage can be overcome and toner particles of excellent color prepared by cooling the toner particle containing dispersion and grinding the particles in the presence of carbon steel particulate media.

DISCLOSURE OF THE INVENTION

In accordance with this invention there is provided a process for preparing toner particles for electrostatic imaging comprising (A) dispersing at an elevated temperature in a vessel a thermoplastic resin, a dispersant nonpolar liquid having a Kauri-butanol value of less than 30, and a colorant other than black, while maintaining the temperature in the vessel at a temperature sufficient to plasticize and liquify the resin and below that at which the dispersant nonpolar liquid degrades and the resin and/or colorant decomposes; (B) cooling the dispersion, either (1) without stirring to form a gel or solid mass, followed by shredding the gel or solid mass and grinding by means of particulate media in the presence of additional liquid;

(2) with stirring to form a viscous mixture an grinding by means of particulate media in the presence of additional liquid; or (3) while grinding by means of particulate media to prevent the formation of a gel or solid mass in the presence of additional liquid; and (C) separating the dispersion of toner particles having an average by area particle size of less than 10 μm from the particulate media, the improvement whereby the particulate media are carbon steel.

The process of this invention results in toner particles adapted for electrophoretic movement through a nonpolar liquid. The toner particles which have excellent color may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The toner particles are prepared from at least one thermoplastic polymer or resin, suitable colorants and dispersant nonpolar liquids as described in more detail below. In addition, a polar additive having a Kauri-butanol value of at least 30 may be present at least during the grinding stage of the process. preferably the polar additive, if used, is present initially in the process in an amount of 0.5 to 99% by weight of the total weight of liquid. Additional components can be added, e.g., charge director, polyethylene, fine particle size oxides such as silica, etc.

Useful thermoplastic resins or polymers which can form fibers include: ethylene vinyl acetate (EVA) copolymers (Elvax® resins, E. I. du Pont de Nemours and Company, Wilmington, DE), copolymers of ethylene and an α,β-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%) polyethylene isotactic polypropylene (crystalline), ethylene ethyl acrylate series sold under the trademark Bakelite® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.: Surlyn® ionomer resin by E. I. du Pont de Nemours and Company, Wilmington, DE, etc. Preferred copolymers are the copolymer of ethylene and an $\alpha$, $\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 procedure A. particularly preferred copolymers of this type have an acid number of 66 and 60 and a melt index of 100 and 500 determined at 190° C., respectively.

In addition the resins have the following characteristics:

1. Be able to disperse the colorant, e.g., pigment,
2. Be insoluble in the dispersant liquid including any polar liquid at temperatures below 40° C. so that it will not dissolve or solvate in storage,
3. Be able to solvate at temperatures above 50° C.,
4. Be able to be ground to form particles between 0.1 $\mu$m and 5 $\mu$m, in diameter,
5. Be able to form a particle (average by area) of less than 10 $\mu$m e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 $\mu$m, and a particle size cut of 1.0 $\mu$m.
6. Be able to fuse at temperatures in excess of 70° C.

By solvation in 3. above, the resins forming the toner particles will become swollen or gelatinous.

Colorants such as pigments or dyes and combinations thereof, are present. The colorant, e.g., a pigment, may be present in the amount of up to 60 percent by weight based on the weight of the resin. Examples of pigments are Monastral® Blue G (C.I pigment Blue 15 C.I. No. 74160), Toluidine Red Y (C.I. pigment Red 3) Quindo® Magenta (Pigment Red 122), Indo® Brilliant Scarlet (Pigment Red 123, C.I. No. 71145), Toluidine Red B (C.I. Pigment Red 3). Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1) Monastral® Blue B (C.I. Pigment Blue 15) Monastral® Green B (C.I. Pigment Green 7), Pigment Scarlet (C.I. Pigment Red 60) Auric Brown (C.I. Pigment Brown 6) Monastral® Green G (Pigment Green 7), etc. Black pigments do not show a perceptible change of color when prepared by other dispersion and grinding processes and are not included as pigments according to this invention. Fine particle size oxides, e.g., silica, alumina, titania, etc.; preferably in the order of 0.5 $\mu$m or less can be dispersed into the liquified resin in combination with the colorants.

The dispersant nonpolar liquids are, preferably, branched-chain aliphatic hydrocarbons and more particularly, Isopar®-G Isopar®-H, Isopar®-K, Isopar®-L, and Isopar®-M. These hydrocarbon liquids are narrow cuts of isoparaffinic hydrocarbon fractions with extremely high levels of purity. For example, the boiling range of Isopar®-G is between 157° C., and 176° C., Isopar®-H between 176° C. and 191° C. Isopar®-K between 177° C. and 197° C., Isopar®-L between 188° C. and 206° C. and Isopar®-M between 207° C. and 254° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |
| Norpar® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C. Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the Vicinity of 27 or 28, determined by ASTM D 1133. The ratio of thermoplastic resin to dispersant nonpolar liquid is such that the combination of ingredients becomes fluid at the working temperature.

Into a suitable mixing or blending vessel, e.g., attritor, heated ball mill, heated vibratory mill such as a Sweco Mill manufactured by Sweco Co., Los Angeles, CA, equipped with carbon steel particulate media for dispersing and grinding, Ross double planetary mixer manufactured by Charles Ross and Son, Hauppauge, NY, etc., are placed the above-described ingredients. Generally the resin, dispersant nonpolar liquid and colorant are placed in the vessel prior to starting the dispersing step although after homogenizing the resin and the dispersant nonpolar liquid the colorant can be added. polar additive can also be present in the vessel, e.g., 0.5 to 99% based on the weight of polar additive and dispersant nonpolar liquid. The dispersing step is generally accomplished at elevated temperature, i.e., the temperature of ingredients in the vessel being sufficient to plasticize and liquify the resin but being below that at which the dispersant nonpolar liquid or polar additive, if present, degrades and the resin and/or colorant decomposes. A preferred temperature range is 80° C. to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful carbon steel particulate media can be spherical, cylindrical, etc., the former being preferred. A typical diameter range for the carbon steel particulate media is in the range of 0.04 to 0.5 inch (1.0 to ~13 mm). The carbon steel balls are commercially available and can be case hardened and through hardened. The case hardened carbon steel balls preferably have a Rockwell hardness of about 60, with a carbon content in the range of about 0.11% to 0.16% by weight as well as amounts of other elements such as Mn, Si, S and P as specified in Example 2 below in addition to Fe.

Suitable polar liquids which may be used if desired, have a Kauri-butanol value of at least 30 include: aromatic hydrocarbons of at least 6 carbon atoms, e.g., benzene, toluene, naphthalene, other substituted benzene and naphthalene compounds; monohydric, dihydric and trihydric alcohols of 1 to 12 carbon atoms and more, e.g., methanol, ethanol, butanol, propanol, dodecanol, etc., ethylene and other glycols, Cellosolve; etc.

After dispersing the ingredients in the vessel with or without a polar additive present, until the desired dispersion is achieved, typically 1 hour with the mixture being fluid the dispersion is cooled, e.g., in the range of 0° C. to 50° C. Cooling may be accomplished for example, in the same vessel, such as the attritor, while simultaneously grinding in the presence of additional liquid with the particulate media to prevent the formation of a gel or solid mass; without stirring to form a gel or solid mass, followed by shredding the gel or solid mass and grinding, e.g., by means of the particulate media in the presence of additional liquid; or with stirring to form a viscous mixture and grinding by means of the particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time. In a grinding time of about 2 hours or less using polar liquid, particles in the average size (by area) of 0.1 to 5 μm are achieved. Longer grindinq times can be used, if desired.

After cooling and separating the dispersion of toner particles from the carbon steel particulate media by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid, polar liquid, or combinations thereof. The dilution is conducted to reduce the concentration of toner particles to between 0.1 to 10 percent by weight, preferably 0.5 to 2 weight percent with respect to the dispersant nonpolar liquid, if present as the additional liquid.

One or more charge directors as known to those skilled in the art can be added to impart a positive or negative charge as desired. The charge director may be added at any time during the process. If a diluting dispersant nonpolar liquid is also added, the charge director can be added prior to, concurrently with, or subsequent thereto. Generally 1 to 100 mg/g toner solids of the charge director is required. Suitable positive charge directors are sodium dioctylsulfosuccinate (manufactured by American Cyanimid Co.), zirconium octoate and metal soaps such as copper oleate, etc. Suitable negative charge directors are lecithin, barium petronate, calcium petronate (Witco Chemical Corp., New York, NY), alkyl succinimide (manufactured by Chevron Chemical Company of California), etc. The conductivity which has proven particularly useful is in the range of about 5 to 100 pmho/cm. A preferred mode of the invention is described in Example 1.

INDUSTRIAL APPLICABILITY

The process of this invention surprisingly results in dispersed toner particles having excellent color conformity. The toner is of the liquid type and is particularly useful in copying, e.g., making office copies of various colors; or color proofing, e.g., a reproduction of an image using the standard colors: yellow, cyan and magenta together with black as desired. In copying and proofing the toner particles are applied to a latent electrostatic image. The toner particles may have integrally extending therefrom, the fibers may interdigitate, intertwine, or interlink physically in an image developed with a developing liquid through which has been dispersed the toner particles. The result is an image having excellent color, superior sharpness, line acuity, i.e., edge acuity, and a high degree of resolution. The salient feature of the developed image is that it has good compressive strength, so that it may be transferred from the surface on which it is developed to a carrier sheet without squash. Because of the intertwining of the toner particles, a thicker, denser image may be built up and good sharpness still obtained. The thickness can be controlled by varying the charge potential on the photoconductor, by varying the development time, by varying the toner-particle concentration, by varying the conductivity of the toner particles, by varying the charge characteristics of the toner particles, by varying the particle size, or by varying the surface chemistry of the particles. Any or a combination of these methods may be used. The image is capable of being transferred to a carrier sheet or receptive support such as papers of the type described in the examples below, flexible films, e.g., polyethylene terephthalate; cardboard, rubber, etc.

EXAMPLES

The following examples wherein the parts and percentages are by weight illustrate but do not limit the invention. In the Examples the melt indices were determined by ASTM D1238, procedure A, and the average particle size by area was monitored and determined by an Horiba CAPA-500 centrifugal particle analyzer as described above.

EXAMPLE 1

In a Union Process 0-1 Attritor, Union Process Company, Akron, Ohio, was placed the following ingredients the amounts indicated:

| INGREDIENT | AMOUNT (g) |
|---|---|
| Copolymer of ethylene (89%) and methacrylic acid (11%), Melt Index at 190° C. is 100, Acid No. is 66 | 25.0 |
| Cab-O-Sil ® EH-5 fumed silica, Cabot Corporation, Boston, MA | 5.0 |
| Isopar ®-L, nonpolar liquid having a Kauri-butanol value of 27, Exxon Corporation | 125.0 |

The ingredients were heated to 100° C.±10° C. and milled at an air motor pressure of 30 psi with 0.1875 inch (4.76 mm) diameter through hardened carbon steel balls purchased from Hoover Universal Inc., Cumming, GA, for 1 hour. 3.33 Grams of Dalamar ® Yellow YT-858D pigment manufactured by Heubach, Inc., Newark, NJ, were added. Milling was then continued for 30 minutes. The attritor was cooled to 42° C.±5° with cooling water while the milling was continued and then 88 grams of Isopar ®-H, dispersant nonpolar liquid having a Kauri-butanol value of 27, Exxon Corporation, were added. Milling was continued for 22 hours at an air motor pressure of 40 psi with continued cooling whereby a dispersion of toner particles having an average particle size (by area) of about 1.6 μm was obtained with 16.1% of the particles being greater than 3 μm and none greater than 10 μm. The resulting toner had a bright yellow color.

A control sample was prepared by the procedure described above except stainless steel balls, type 440C, were used in place of the carbon steel balls. The resulting toner developed a green discoloration making it unsatisfactory for high quality process color use.

EXAMPLE 2

The following ingredients were used in making a yellow toner:

| INGREDIENT | AMOUNT (g) |
|---|---|
| Copolymer of ethylene (89%) and methacrylic acid (11%), Melt Index at 190° C. is 100, Acid No. is 66 | 500.0 |
| Dalamar ® Yellow YT-858D pigment, Heubach, Inc., Newark, NJ | 66.7 |
| Cab-O-Sil ® EH-S Fumed Silica, Cabot Corp., Boston, MA | 100.0 |
| Isopar ®-L, nonpolar liquid having Kauri-butanol value of 27, Exxon Corporation | 2,000.0 |

The ethylene/methacrylic acid copolymer and 500 grams of the Isopar ®-L were charged to a Ross double planetary jacketed mixer, Model LDM, Charles Ross and Son, Hauppauge, NY. The mixture was heated to 85°-90° C. and stirred at a speed setting of 7 until the resin was melted. The pigment and silica were then added and mixing continued at the same speed and temperature. The remaining amount of Isopar ®-L was then added at a rate such that the temperature was maintained at 85°-90° C. After completion of this addition, the gel was poured out into pans and allowed to cool at room temperature resulting in 2201 grams of bright yellow gel. 100 Grams of the gel were ground in a Waring Blender, Waring Products Division, Dynamics Corporation of America, New Hartford, Conn., to reduce the material to coarse powder. The ground gel was placed in a Union Process 0-1 Attritor, Union Process Company, Akron, Ohio, along with 150 grams of Isopar ®-H, nonpolar liquid having a Kauri-butanol value of 27, Exxon Corporation. The ingredients were milled at an air motor pressure of 40 psi with 0.1875 inch (4.76 mm) diameter case hardened carbon steel balls containing 0.11% to 0.16% carbon, 0.60% to 0.90% Mn, 0.1% to 0.2% Si, less than 0.05% S and less than 0.04% p, and having a Rockwell hardness of 60 purchased from Union Process Company, Akron, Ohio for 6.5 hours and the mixture was maintained at a temperature of 20° C. by running cooling water through the jacket of the attritor. The resulting toner remained bright yellow and had an average particle size (by area) of 1.78 μm, with 21.7% greater than 3 μm and 4% greater than 10 μm.

A control sample was prepared using the procedure described above except the same size stainless steel balls were used instead of the carbon steel balls. The resulting toner had a greenish yellow color which was unacceptable for high quality process color work.

EXAMPLE 3

The following ingredients were used in making a yellow toner:

| INGREDIENT | AMOUNT (g) |
|---|---|
| Copolymer of ethylene (89%) and methacrylic acid (11%), Melt Index at 190° C. is 100, Acid No. is 66 | 500.0 |
| Dalamar ® Yellow YT-839-P yellow pigment flushed in mineral oil (25.1% solids), Heubach, Inc., Newark, NJ | 182.0 |
| Isopar ®-L, nonpolar liquid having a Kauri-butanol value of 27, Exxon Corporation | 500.0 |
| Isopar ®-H, nonpolar liquid having Kauri-butanol value of 27, Exxon Corporation | 172.0 |

The ethylene/methacrylic acid copolymer and Isopar ®-L were charged to a Ross Double planetary jacketed mixer, Model LDM manufactured by Charles Ross and Son Company, Hauppauge, NY. The mixture was heated to 85°-90° C. and stirred at a speed setting of 7 until the resin was melted. The oil flush of the pigment was then added and mixing continued at the same speed and temperature. After the pigment was well dispersed the steam was shut off and the mixture was allowed to cool slowly with continued stirring. The material was collected as a thin soupy liquid when the temperature reached 30° C. 2273 Grams of product were obtained.

83 Grams of this product, and the Isopar ®-H were placed in a Union Process 0-1 Attritor, Union Process Company, Akron, Ohio, and milled at an air motor pressure of 40 psi with 0.1875 inch (4.76 mm) diameter carbon steel balls as described in Example 2 for 12.5 hours. The resulting toner was bright yellow and had an average particle (by area) size of 1.69 μm, with 13.5% greater than 3 μm and 7.1% greater than 10 μm.

A control sample was prepared using the procedure described above except the same size stainless steel balls were used instead of the carbon steel balls. The resulting toner had a greenish yellow color which was unacceptable for high quality process color work. This toner had an average particle size of 1.38 μm, with 8.7% greater than 3 μm and 2.3% greater than 10 μm.

I claim:

1. A process for preparing toner particles for electrostatic imaging comprising

A. dispersing at an elevated temperature in a vessel a thermoplastic resin, a dispersant nonpolar liguid having a Kauri-butanol value of less than 30, and a colorant other than black, while maintaining the temperature in the vessel at a temperature sufficient to plasticize and liquify the resin and below that at which the dispersant nonpolar liquid degrades and the resin and/or colorant decomposes;

B. cooling the dispersion, either (1) without stirring to form a gel or solid mass, followed by shredding the gel or solid mass and grinding by means of particulate media in the presence of additional liguid;

(2) with stirring to form a viscous mixture and grinding by means of particulate media in the presence of additional liquid; or (3) while grinding by means of particulate media to prevent the formation of a gel or solid mass in the presence of additional liquid; and C. separating the dispersion of toner particles having an average by area particle size of less than 10 μm from the particulate media, the improvement whereby the particulate media are carbon steel.

2. A process according to claim 1 wherein the particulate media are spherical having an average diameter of 0.04 to 0.5 inch.

3. A process according to claim 1 wherein the thermoplastic resin is a copolymer of ethylene and an α-β-ethylenically unsaturated acid selected from the class consisting of acrylic acid and methacrylic acid.

4. A process according to claim 1 wherein the thermoplastic resin is an ethylene vinyl acetate copolymer.

5. A process according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

6. A process according to claim 3 wherein the thermoplastic resin is a copolymer of ethylene (89%) and methacrylic acid (11%) having a melt index at 190° C. of 100.

7. A process aocording to claim 1 wherein a combination of colorants is present.

8. A process according to claim 1 wherein after step C a charge director is added to the dispersion to impart an electrostatic charge of predetermined polarity to the toner particles.

9. A process according to claim 1 wherein a plurality of thermoplastic resins are employed in the dispersing step A.

10. A process according to claim 9 wherein the thermoplastic resin is a copolymer of ethylene (89%) and methacrylic acid (11%) having a melt index at 190° C. of 100.

11. A process according to claim 1 wherein the toner particles have an average by area particle size of less than 5 μm.

12. A process according to claim 1 wherein cooling the dispersion is accomplished while grinding by means of particulate media to prevent the formation of a gel or solid mass in the presence of additional liquid.

13. A process according to claim 1 wherein cooling the dispersion is accomplished without stirring to form a gel or solid mass, followed by shredding the gel or solid mass and grinding by means of particulate media in the presence of additional liquid.

14. A process according to claim 1 wherein cooling the dispersion is accomplished with stirring to form a viscous mixture and grinding by means of particulate media in the presence of additional liquid.

15. A process according to claim 1 wherein there is present, at least during the grinding in step B, 0.5 to 99% by weight of a polar additive having a Kauri-butanol value of at least 30, the percentage based on the total weight of liquid.

16. A process according to claim 1 wherein the 0.5 to 99% of the polar liquid based on the total weight of liquid is present during step A.

17. A process according to claim 1 wherein the polar liquid is taken from the group consisting of aromatic hydrocarbons of at least 6 carbon atoms, monohydric, dihydric and trihydric alcohols of 1 to 12 carbon atoms.

18. A process according to claim 15 wherein the additional dispersant nonpolar liquid, polar liquid or combinations thereof is present to reduce the concentration of toner particles to between 0.1 to 10 percent by weight with respect to the liquid.

19. A process according to claim 15 wherein the thermoplastic resin is a copolymer of ethylene (89%) and methacrylic acid (11%) having a melt index at 190° C. of 100.

* * * * *